US009789352B2

(12) United States Patent
Lalaoua

(10) Patent No.: US 9,789,352 B2
(45) Date of Patent: Oct. 17, 2017

(54) ABDOMINAL EXERCISE DEVICE

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/265,768

(22) Filed: Sep. 14, 2016

(65) Prior Publication Data

US 2017/0014677 A1 Jan. 19, 2017

Related U.S. Application Data

(63) Continuation-in-part of application No. PCT/IB2016/054191, filed on Jul. 13, 2016, which is (Continued)

(51) Int. Cl.
*A63B 23/02* (2006.01)
*A63B 21/00* (2006.01)
(Continued)

(52) U.S. Cl.
CPC ..... *A63B 21/4047* (2015.10); *A63B 21/023* (2013.01); *A63B 21/4033* (2015.10); *A63B 21/4035* (2015.10); *A63B 23/0211* (2013.01); *A63B 23/03525* (2013.01); *A61H 2015/0014* (2013.01); *A61H 2015/0071* (2013.01); *A61H 2201/1261* (2013.01); *A61H 2201/1604* (2013.01); *A61H 2201/1609* (2013.01); *A61H 2201/1623* (2013.01); *A61H 2201/1633* (2013.01); *A61H 2201/1635* (2013.01); *A61H 2201/1669* (2013.01); *A61H 2203/0425* (2013.01); *A61H 2203/0456* (2013.01); *A63B 21/00061* (2013.01); *A63B 21/00065* (2013.01); *A63B 21/0552* (2013.01); *A63B 21/4003* (2015.10); *A63B 26/003* (2013.01); *A63B 41/00* (2013.01); *A63B 2022/0097* (2013.01); *A63B 2023/006* (2013.01); *A63B 2225/09* (2013.01)

(58) Field of Classification Search
None
See application file for complete search history.

(56) References Cited

U.S. PATENT DOCUMENTS 5,573,485 A * 11/1996 Geschwender .... A63B 23/0233 482/112
5,772,614 A * 6/1998 Lindquist ..... A63B 21/00061 601/116

(Continued)

*Primary Examiner* — Stephen R Crow

(57) ABSTRACT

An abdominal exercise device is used to exercise and strengthen core muscles. The device includes a hinged frame, a first plurality of rolling supports, a second plurality of rolling supports and a rocking base. The first plurality of rolling supports and the second plurality of rolling supports are connected along the hinged frame laterally opposite each other. Together, the hinged frame, the first plurality of rolling supports and the second plurality of rolling supports are used to interact and brace portions of the user's back as the user performs an exercise. The rocking base is connected to the hinged frame and is used as a pivot point about which the user and the rest of the device can rock, tilt, or rotate. A frame-grasping assembly is mounted to the hinged frame. The frame-grasping assembly allows the user to hold onto the device and maintain stability while performing exercises.

13 Claims, 9 Drawing Sheets

Related U.S. Application Data a continuation-in-part of application No. 15/204,863, filed on Jul. 7, 2016, application No. 15/265,768, which is a continuation-in-part of application No. PCT/IB2016/005542, filed on Sep. 12, 2016, which is a continuation-in-part of application No. 15/258,047, filed on Sep. 7, 2016, application No. 15/265,768, which is a continuation-in-part of application No. PCT/IB2016/053903, filed on Jun. 29, 2016, which is a continuation-in-part of application No. 15/187,567, filed on Jun. 20, 2016, application No. 15/265,768, which is a continuation-in-part of application No. PCT/IB2016/054213, filed on Jul. 14, 2016, and a continuation-in-part of application No. 29/577,628, filed on Sep. 14, 2016.

(60) Provisional application No. 62/283,840, filed on Sep. 14, 2015, provisional application No. 62/231,629, filed on Jul. 13, 2015.

(51) Int. Cl.

| | |
|---|---|
| ***A63B 21/02*** | (2006.01) |
| ***A63B 23/035*** | (2006.01) |
| *A63B 21/055* | (2006.01) |
| *A63B 26/00* | (2006.01) |
| *A63B 41/00* | (2006.01) |
| *A63B 22/00* | (2006.01) |
| *A63B 23/00* | (2006.01) |
| *A61H 15/00* | (2006.01) |

(56) References Cited

U.S. PATENT DOCUMENTS

| | | | | |
|---|---|---|---|---|
| 6,231,489 | B1 * | 5/2001 | McBride | A63B 21/068 482/132 |
| 6,312,401 | B1 * | 11/2001 | Smith | A61H 1/0218 482/142 |
| 6,971,977 | B1 * | 12/2005 | Chen | A63B 21/0552 297/258.1 |
| 7,125,366 | B1 * | 10/2006 | Yeh | A63B 21/055 482/122 |
| 7,326,159 | B2 * | 2/2008 | Rong | A63B 21/0004 482/140 |
| 2006/0068979 | A1 * | 3/2006 | Hsieh | A63B 21/00047 482/140 |
| 2015/0105226 | A1 * | 4/2015 | Lalaoua | A63B 23/0205 482/140 |

* cited by examiner

ABDOMINAL EXERCISE DEVICE

The current application claims a priority to the U.S. Provisional Patent application Ser. No. 62/283,840 filed on Sep. 14, 2015.

FIELD OF THE INVENTION

The present invention relates generally to exercise devices. More specifically, the present invention is an abdominal exercise device that is used to rock or tilt, as well as resist a user's movement in order to strengthen core muscles.

BACKGROUND OF THE INVENTION

Exercising core muscles is a common way to stay physically fit. Specific exercises that target core muscles, including sit-ups, crunches, and planks can be useful for strengthening abdominal muscles but can also lead to injuries. Further, performing such exercises on hard surfaces can prove to be uncomfortable. Existing workout devices or machines typically move in one direction. This limits what exercises a user can perform. Further, repeatedly performing the same exercises can lead to decreased results when compared to varying exercise routines.

Accordingly, there is a present need for an exercise machine capable of comfortably and safely supporting a user through the performance of various abdominal exercises. The present invention is an abdominal exercise device that supports users while rocking or tilting on the present invention in order to strengthen core muscles. The present invention uses a hinged frame that bends with the user to provide stability throughout the user's full range of motion. Further, the present invention resists the movements of the user in order to enhance the strengthening of core muscles.

DETAILED DESCRIPTION OF THE INVENTION

All illustrations of the drawings are for the purpose of describing selected versions of the present invention and are not intended to limit the scope of the present invention.

Figure 1:
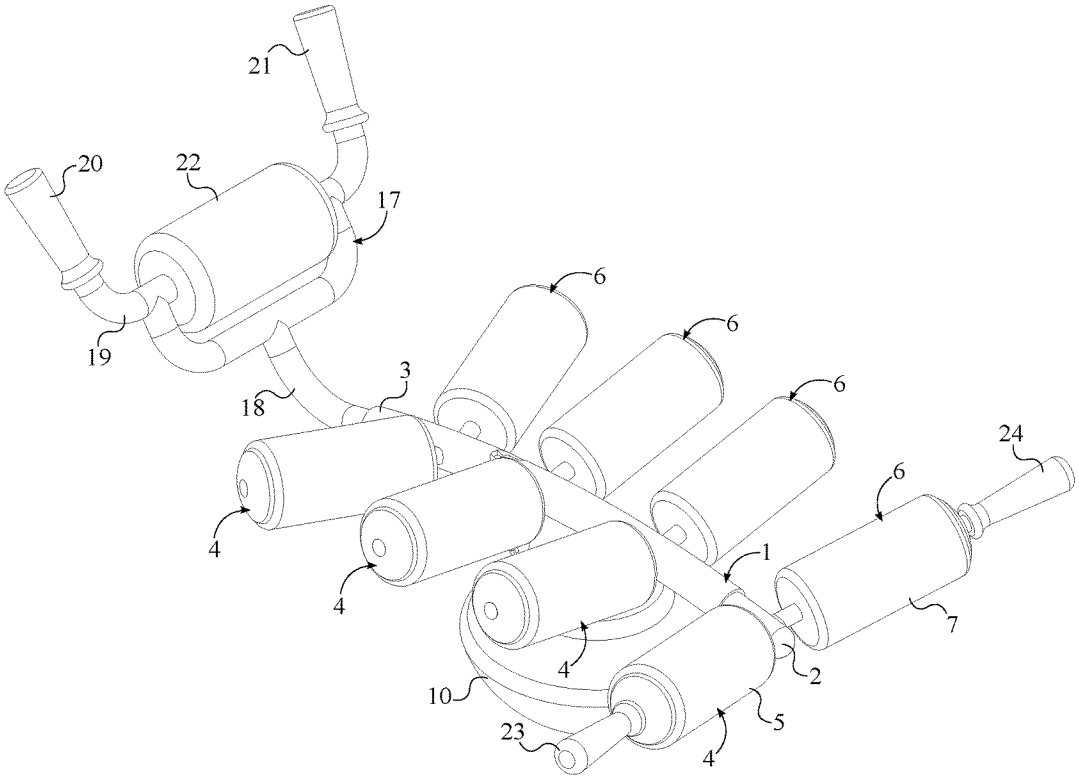
FIG. 1 is a top perspective view of the present invention with the hinged frame unfolded.
Figure 2:
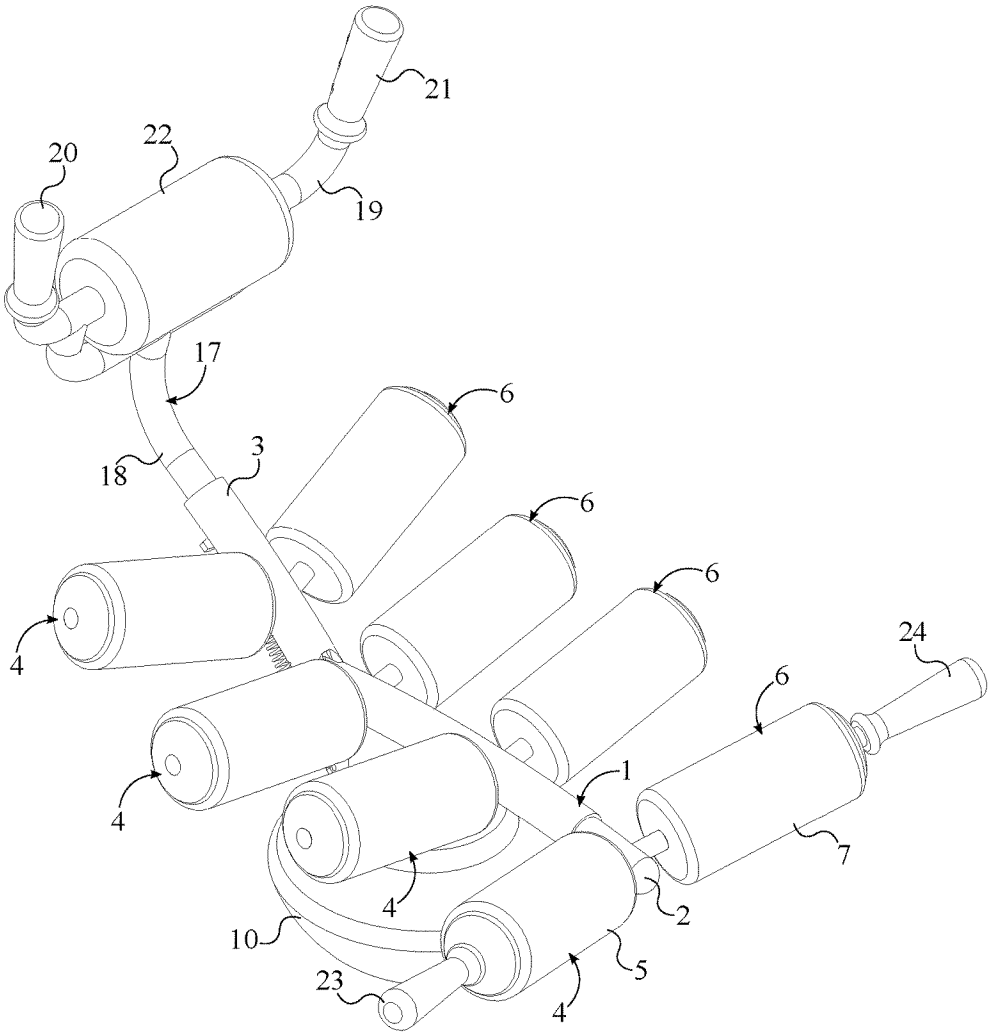
FIG. 2 is a top perspective view of the present invention with the hinged frame folded.

With reference to FIGS. 1-2, the present invention is an abdominal exercise device used to strengthen a user's core muscles. The present invention comprises a hinged frame 1, a first plurality of rolling supports 4, a second plurality of rolling supports 6, a rocking base 10, and a frame-grasping assembly 17. The hinged frame 1 is used to support the weight of the user during exercise. Further, the hinged frame 1 is designed to fold during exercise in order to move as the user moves. The hinged frame 1 comprises a base beam 2 and a pivoting beam 3. During exercise, the user lays along the hinged frame 1 and is supported by the first plurality of rolling supports 4 and the second plurality of rolling supports 6. The base beam 2 is primarily used for supporting the user's lower back, while the pivoting beam 3 is used to support the user's mid and upper back. The pivoting beam 3 is hingedly and adjacently connected to the base beam 2. This arrangement between the base beam 2 and the pivoting beam 3 allows the hinged frame 1 to bend as the user performs crunches or similar exercises while using the present invention. The frame-grasping assembly 17 is adjacently mounted to the pivoting beam 3, opposite to the base beam 2. The frame-grasping assembly 17 provides a means by which the user can hold onto the present invention while exercising. This helps to ensure that the hinged frame 1 moves with the user and constantly provides support for the user.

In reference to FIGS. 1-2, the first plurality of rolling supports 4 and the second plurality of rolling supports 6 are both used to evenly distribute the weight of the user along the hinged frame 1. The first plurality of rolling supports 4 is laterally mounted to the hinged frame 1. The second plurality of rolling supports 6 is also laterally mounted to the hinged frame 1 but is positioned opposite to the first plurality of rolling supports 4. The first plurality of rolling supports 4 and the second plurality of rolling supports 6 are distributed along the hinged frame 1. This helps to maximize comfort and support. Each of the first plurality of rolling supports 4 is longitudinally aligned with a corresponding support from the second plurality of rolling supports 6. As the user exercises with the present invention, each support from the first plurality of rolling supports 4 and second plurality of rolling supports 6 is able to rotate, allowing the user to move unimpeded. The rocking base 10 is laterally mounted to the base beam 2. The rocking base 10 allows the hinged frame 1 to be oriented in a plurality of positions. As a result, the user is able to perform various exercises with the present invention.

Figure 3:
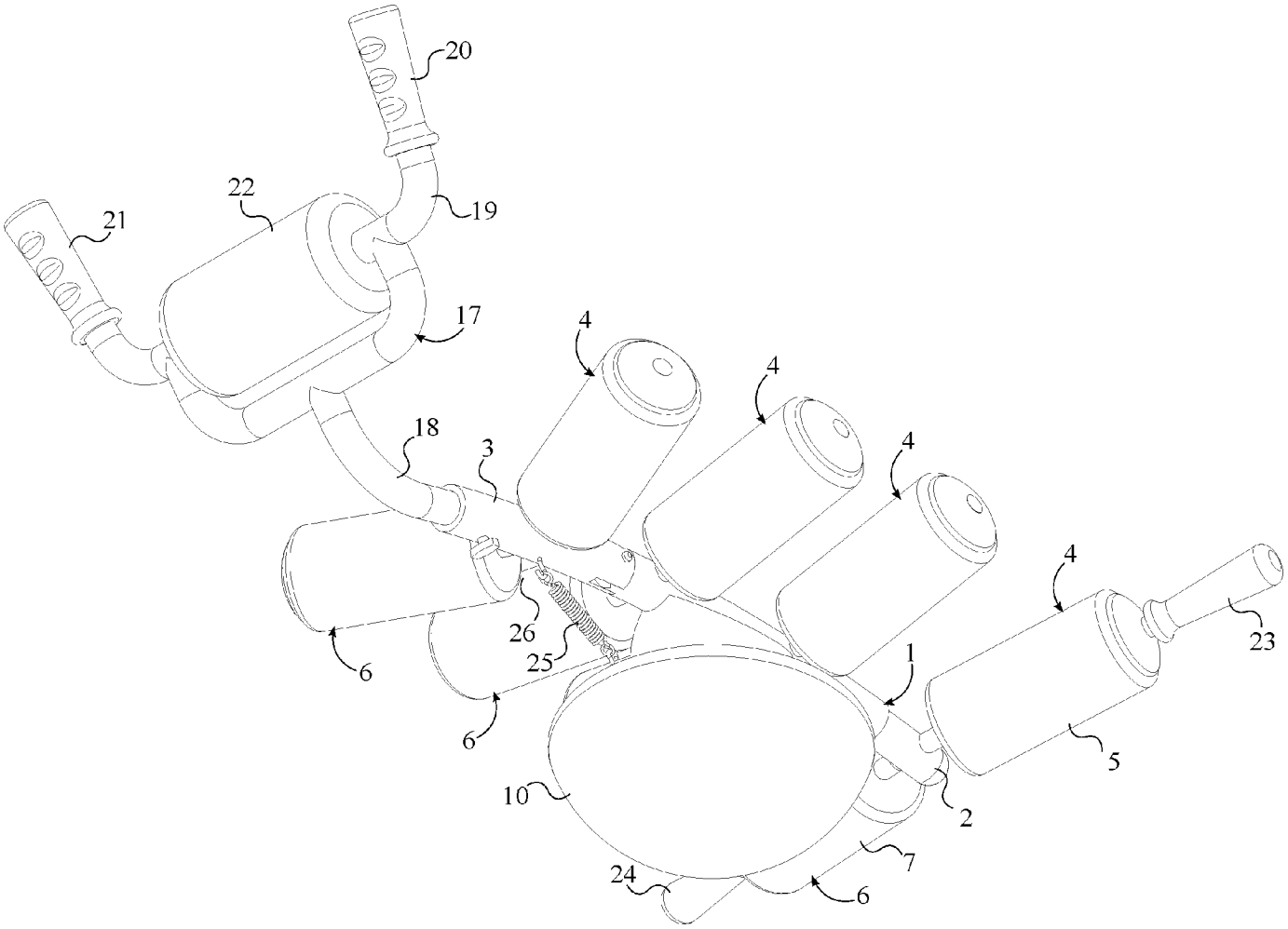
FIG. 3 is a bottom perspective view of the present invention with the hinged frame unfolded.

In reference to FIG. 1 and FIG. 3, the frame-grasping assembly 17 comprises a length-adjusting bar 18, a handlebar 19, a first grip 20, a second grip 21, and a neck rest 22. The length-adjusting bar 18 is used to selectively position the neck rest 22 and the handlebar 19 with respect to the pivoting beam 3. The length-adjusting bar 18 is telescopically mounted into the pivoting beam 3 and is positioned opposite to the base beam 2. As a result, the length-adjusting bar 18 may be slid into or out of the pivoting beam 3 so that the neck rest 22 may comfortably support the user's neck and the handlebar 19 may be easily reached while exercising. The handlebar 19 is connected adjacent to the length-adjusting bar 18, opposite to the pivoting beam 3. The handlebar 19 is used to maneuver the hinged frame 1 during exercises. The first grip 20 and the second grip 21 are grasped by the user to prevent the user's hands from slipping while maneuvering the handlebar 19. The first grip 20 is connected adjacent to the handlebar 19. The second grip 21 is connected adjacent to the handlebar 19, opposite to the first grip 20. The neck rest 22 is laterally connected about the handlebar 19 and is used to support the user's head and neck area during exercise. The neck rest 22 is positioned in between the first grip 20 and the second grip 21. This arrangement between the neck rest 22, the first grip 20, and the second grip 21 allows the user to comfortably align their head and neck with the hinged frame 1, while holding onto the first grip 20 and the second grip 21.

In reference to FIG. 1, the present invention further comprises a first handle 23 and a second handle 24. In addition to the first grip 20 and the second grip 21, the first handle 23 and the second handle 24 are used to help the user maneuver the hinged frame 1 and maintain balance during exercises. The first plurality of rolling supports 4 comprises a first end support 5 and the second plurality of rolling supports 6 comprises a second end support 7. The first end support 5 and the second end support 7 are positioned opposite to the frame-grasping assembly 17 along the hinged frame 1. The first handle 23 is connected adjacent to the first end support 5, opposite to the base beam 2. Similarly, the second handle 24 is connected adjacent to the second end support 7 opposite to the base beam 2. The positioning of the first grip 20, the second grip 21, the first handle 23, and the second handle 24 allows the user to hold onto the present invention at either end of the hinged frame 1, depending on the exercise the user is performing or the user's preference. In the preferred embodiment of the present invention, the first handle 23 and the second handle 24 may either be made from a heavy material or filled with a weights. This is done to make the present invention naturally unbalanced in a manner that the first handle 23 and the second handle 24 will rotate towards the ground when the user dismounts from the present invention.

Figure 6:
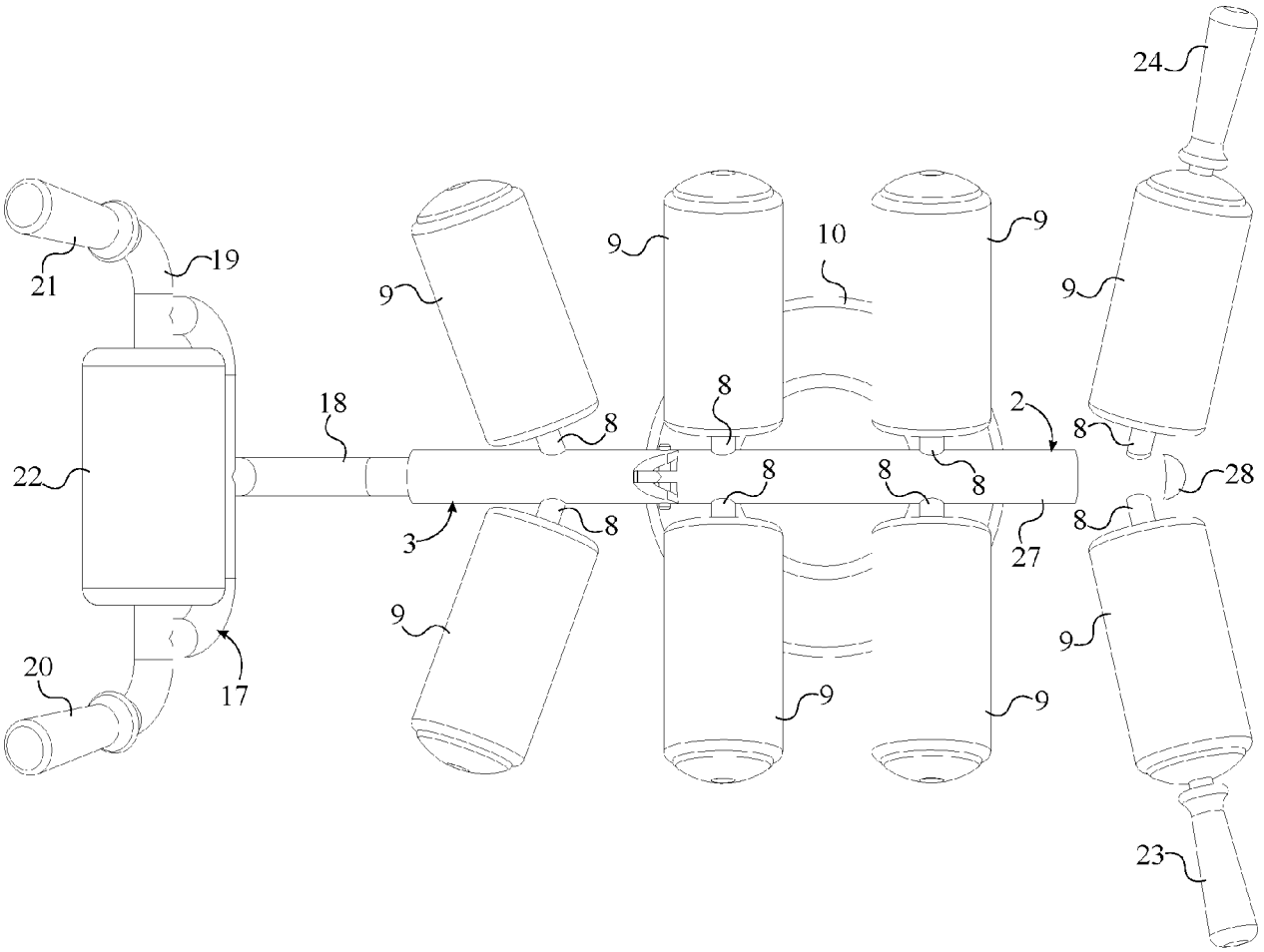
FIG. 6 is a top view of the present invention.

In reference to FIG. 1 and FIG. 6, the base beam 2 comprises a base-supporting beam 27 and a base-adjusting beam 28. The base-adjusting beam 28 is telescopically mounted into the base-supporting beam 27 such that the length of the base beam 2 may be increased or decreased. This arrangement allows the present invention to be adjusted to support users of varying heights. In order to distribute the weight of the user evenly, the first end support 5 and the second end support 7 are laterally connected to the base-adjusting beam 28.

In reference to FIG. 6, each rolling support from the first plurality of rolling supports 4 and from the second plurality of rolling supports 6 comprises an arm 8 and a cushioned roller 9. The arm 8 is laterally connected to the hinged frame 1 and is used to support a portion of the user's back. The cushioned roller 9 is rotatably mounted about the arm 8. The cushioned roller 9 is used to distribute weight evenly onto the arm 8. The cushioned roller 9 has a greater surface area than the arm 8 so that the user does not experience pressure at any point on their back.

Figure 4:
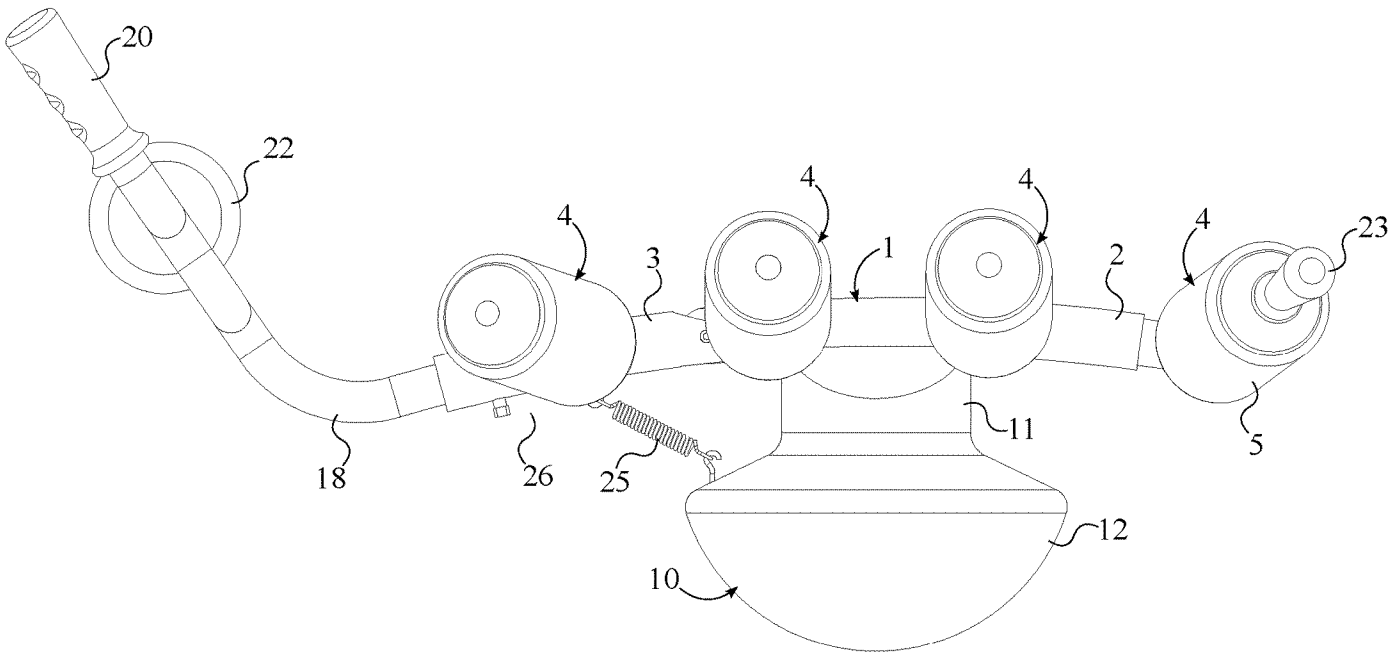
FIG. 4 is a front view of the present invention with the hinged frame unfolded.
Figure 5:
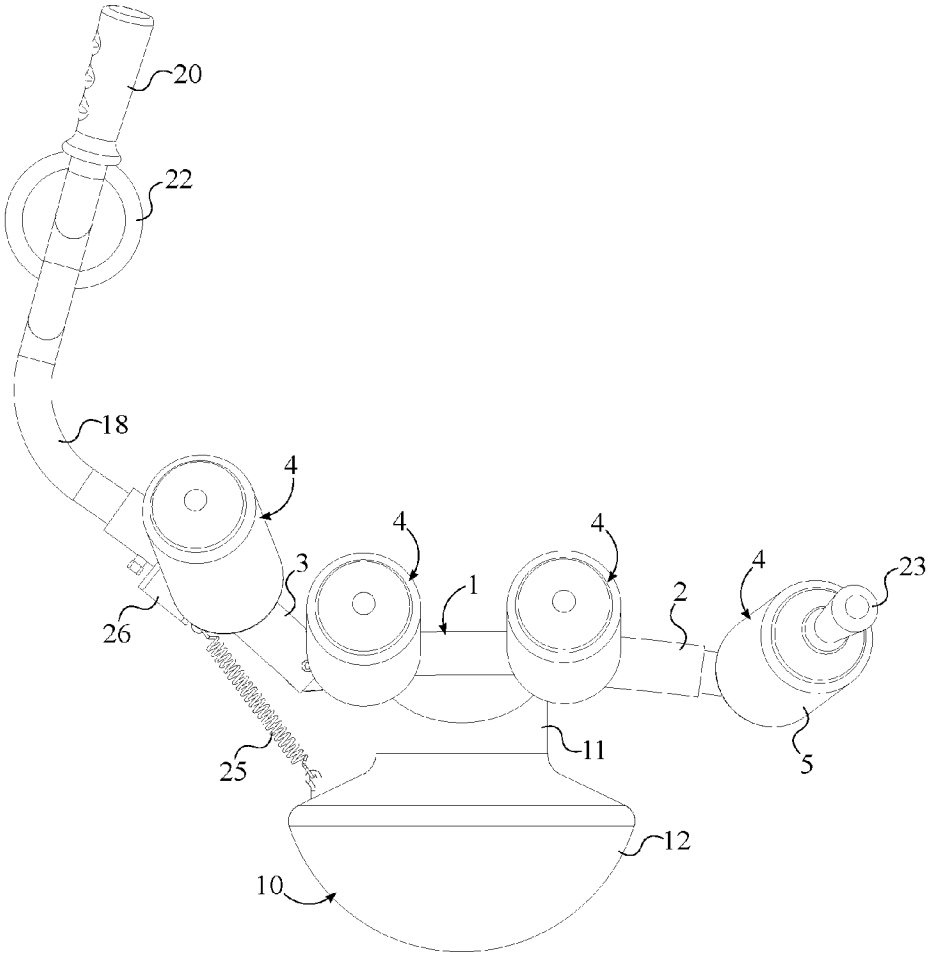
FIG. 5 is a front view of the present invention with the hinged frame folded.

In reference to FIGS. 4-5, the present invention further comprises an elastic movement resistor 25. The elastic movement resistor 25 is used to resist folding motions of the hinged frame 1. As a result, the user is required to exert a greater force to perform an exercise. The elastic movement resistor 25 is attached in between the pivoting beam 3 and the rocking base 10. As the pivoting beam 3 is folded, the elastic movement resistor 25 is stretched in between the pivoting beam 3 and the rocking base 10. In the preferred embodiment of the present invention, the elastic movement resistor 25 is a tension spring. Alternatively, the elastic movement resistor 25 may be an elastic band. The present invention may be equipped with one or more elastic movement resistors 25 so that one or more elastic movement resistor 25 may be interchanged or used together to achieve varying resistances.

In a first embodiment of the rocking base 10, the rocking base 10 comprises a spacer 11 and a rounded fulcrum 12. In reference to FIG. 4, the spacer 11 is laterally mounted to the base beam 2 and is used to distance the rounded fulcrum 12 from the base beam 2. This is necessary in order to prevent the hinged frame 1 from contacting the ground while the user is performing an exercise. The spacer 11 is positioned in between the first plurality of rolling supports 4 and the second plurality of rolling supports 6. The rounded fulcrum 12 is mounted adjacent to the spacer 11, opposite to the hinged frame 1. During exercises, the rounded fulcrum 12 is placed against the ground and is used as a point about which the present invention can pivot. By moving about the rounded fulcrum 12, the user is able to stretch or workout various muscles in the body.

Figure 7:
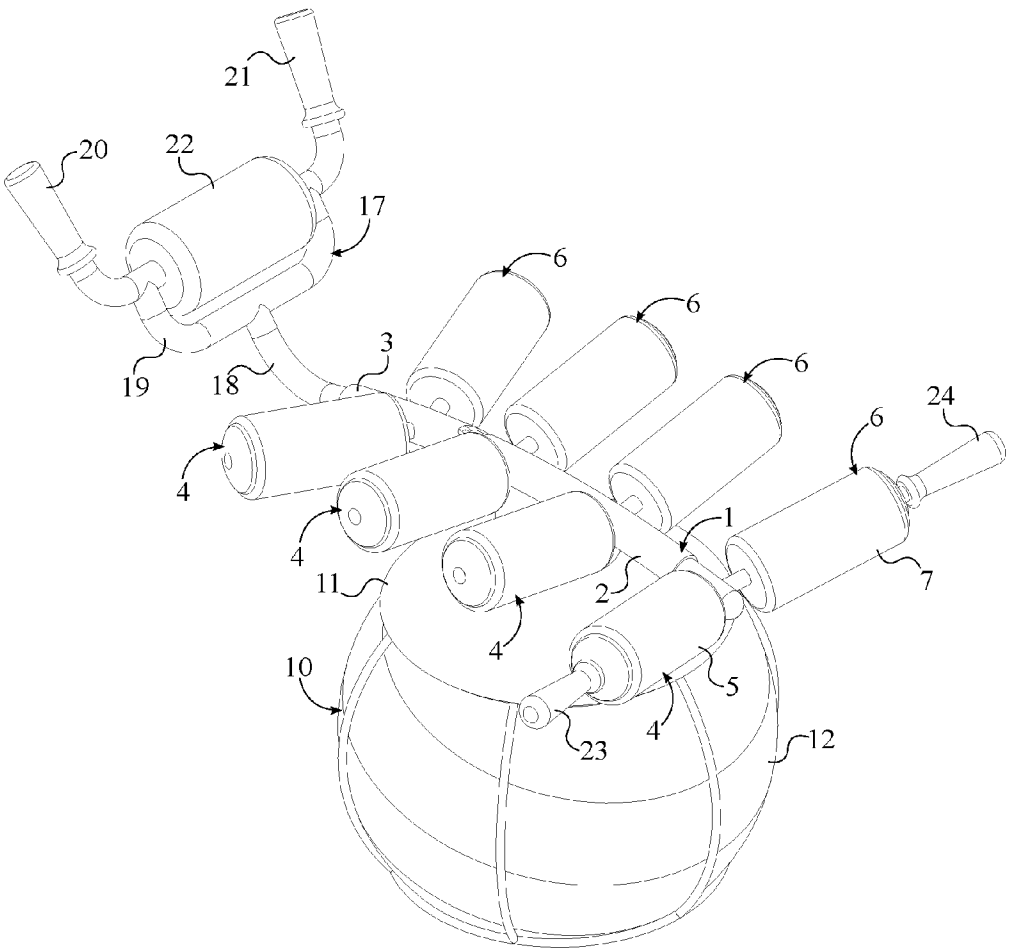
FIG. 7 is a top perspective view of the present invention wherein the rounded fulcrum is a ball.

In a first embodiment of the rocking base 10, the rounded fulcrum 12 is a hemispherical ball which is connected adjacent to the spacer 11. This is shown in FIG. 4. The hemispherical ball design allows for 360° rotations along with rocking or tilting motions. As a result, a wide range of exercises may be performed. In an alternative embodiment of the present invention, shown in FIG. 7, the rounded fulcrum 12 is a spherical ball. Similar to the hemispherical ball, the spherical ball allows for a wide range of exercises. In this embodiment; however, the rounded fulcrum 12 is removably attached to the spacer 11. The spacer 11 may be dimensioned to fit over an existing ball such as an exercise ball.

Figure 8:
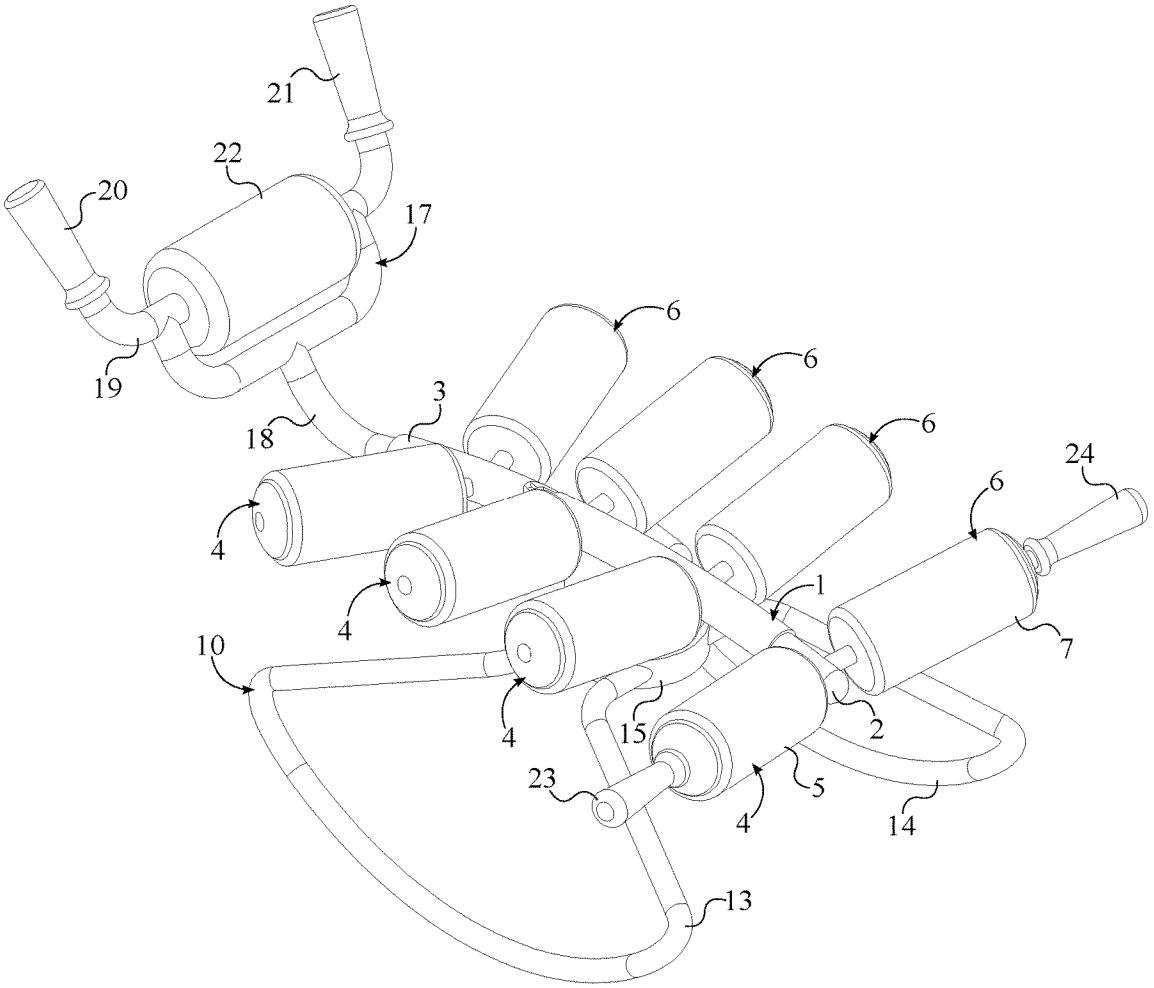
FIG. 8 is a top perspective view of the present invention with the second embodiment of the rocking base, wherein the second embodiment of the rocking base comprises a first rocker and a second rocker.
Figure 9:
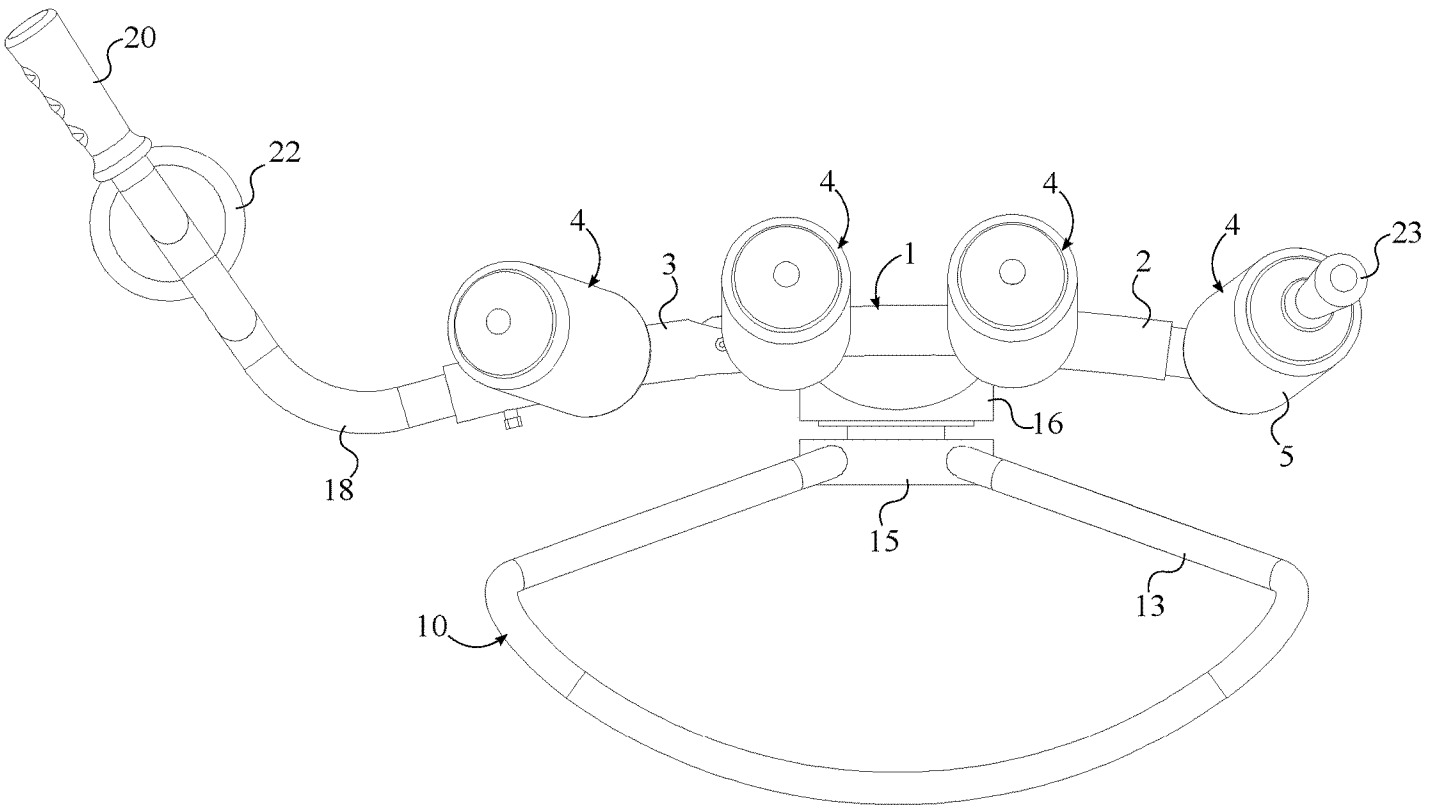
FIG. 9 is a front view of the present invention with the second embodiment of the rocking base.

In reference to FIGS. 8-9, in a second embodiment of the rocking base 10, the rocking base 10 comprises a first rocker 13, a second rocker 14, a bridge 15, and a swiveling mechanism 16. The first rocker 13 is connected adjacent to the bridge 15. The second rocker 14 is connected adjacent to the bridge 15, laterally opposite to the first rocker 13. The first rocker 13 and the second rocker 14 allow the present invention to rock in a single direction. Because the present invention is only able to rock in a single direction, the user may more easily control their positioning on the present invention. The bridge 15 is attached to the base beam 2 through the swiveling mechanism 16. The bridge 15 is used to support the first rocker 13 and the second rocker 14. The swiveling mechanism 16 is used to rotate the rocking base 10 relative to the hinged frame 1. This allows the user to adjust the angle in which the present invention rocks. The user may swap from a front-to-back rocking motion to a side-to-side rocking motion.

In reference to FIG. 3, the present invention further comprises a vibrating device 26. The vibrating device 26 is laterally attached to the pivoting beam 3 and is used to stimulate blood flow in the user's body and may also be used to massage muscles. The vibrating device 26 is positioned adjacent to the base beam 2. The positioning of the vibrating device 26 allows the vibrating device 26 to affect the user's entire back.

Although the invention has been explained in relation to its preferred embodiment, it is to be understood that many other possible modifications and variations can be made without departing from the spirit and scope of the invention as hereinafter claimed.

What is claimed is:

1. An abdominal exercise device comprises:

a hinged frame;

a first plurality of rolling supports;

a second plurality of rolling supports;

a rocking base;

a frame-grasping assembly;

the hinged frame comprises a base beam and a pivoting beam;

the pivoting beam being hingedly and adjacently connected to the base beam;

the frame-grasping assembly being adjacently mounted to the pivoting beam, opposite to the base beam;

the first plurality of rolling supports being laterally mounted to the hinged frame;

the second plurality of rolling supports being laterally mounted to the hinged frame, opposite to the first plurality of rolling supports;

the first plurality of rolling supports and the second plurality of rolling supports being distributed along the hinged frame;

each of the first plurality of rolling supports being longitudinally aligned with a corresponding support from the second plurality of rolling supports; and the rocking base being laterally mounted to the base beam.

2. The abdominal exercise device as claimed in claim 1 comprises:

the frame-grasping assembly comprises a length-adjusting bar, a handlebar, a first grip, a second grip, and a neck rest;

the length-adjusting bar being telescopically mounted into the pivoting beam;

the length-adjusting bar being positioned opposite to the base beam;

the handlebar being connected adjacent to the length-adjusting bar, opposite to the pivoting beam;

the first grip being connected adjacent to the handlebar;

the second grip being connected adjacent to the handlebar, opposite to the first grip;

the neck rest being laterally connected about the handlebar; and the neck rest being positioned in between the first grip and the second grip.

3. The abdominal exercise device as claimed in claim 1 comprises:

a first handle;

a second handle;

the first plurality of rolling supports comprises a first end support;

the second plurality of rolling supports comprises a second end support;

the first end support being positioned opposite to the frame-grasping assembly, along the hinged frame;

the first handle being connected adjacent to the first end support, opposite to the base beam;

the second end support being positioned opposite to the frame-grasping assembly, along the hinged frame; and the second handle being connected adjacent to the second end support, opposite to the base beam.

4. The pivoting abdominal exercise machine as claimed in claim 3 comprises:

the base beam comprises a base-supporting beam and a base-adjusting beam;

the base-adjusting beam being telescopically mounted into the base support beam;

the first end support being laterally connected to the base-adjusting beam; and the second end support being laterally connected to the base-adjusting beam.

5. The abdominal exercise device as claimed in claim 1 comprises:

each rolling support from the first plurality of rolling supports and from the second plurality of rolling supports comprises an arm and a cushioned roller;

the arm being laterally connected to the hinged frame; and the cushioned roller being rotatably mounted about the arm.

6. The abdominal exercise device as claimed in claim 1 comprises:

an elastic movement resistor; and the elastic movement resistor being attached in between the pivoting beam and the rocking base.

7. The abdominal exercise device as claimed in claim 6, wherein the elastic movement resistor is a tension spring.

8. The abdominal exercise device as claimed in claim 6, wherein the elastic movement resistor is an elastic band.

9. The abdominal exercise device as claimed in claim 1 comprises:

the rocking base comprises a spacer and a rounded fulcrum;

the spacer being laterally mounted to the base beam;

the spacer being positioned in between the first plurality of rolling supports and the second plurality of rolling supports; and the rounded fulcrum being mounted adjacent to the spacer, opposite to the hinged frame.

10. The abdominal exercise device as claimed in claim 9 comprises:

the rounded fulcrum being a hemispherical ball; and the rounded fulcrum being connected adjacent to the spacer.

11. The abdominal exercise device as claimed in claim 9 comprises:

the rounded fulcrum being a spherical ball; and the rounded fulcrum being removably attached to the spacer.

12. The abdominal exercise device as claimed in claim 1 comprises:

the rocking base comprises a first rocker, a second rocker, a bridge, and a swiveling mechanism;

the first rocker being connected adjacent to the bridge;

the second rocker being connected adjacent to the bridge, opposite to the first rocker; and the bridge being attached to the base beam through the swiveling mechanism.

13. The abdominal exercise device as claimed in claim 1 comprises:

a vibrating device;

the vibrating device being laterally attached to the pivoting beam; and the vibrating device being positioned adjacent to the base beam.

* * * * *